United States Patent [19]

Rogen et al.

[11] Patent Number: 4,515,213

[45] Date of Patent: May 7, 1985

[54] PACKING TOOL APPARATUS FOR SEALING WELL BORES

[75] Inventors: Neil E. Rogen; Dewa N. Adnyana, both of Houston, Tex.

[73] Assignee: Memory Metals, Inc., Stamford, Conn.

[21] Appl. No.: 464,787

[22] Filed: Feb. 9, 1983

[51] Int. Cl.[3] ..... E21B 33/12

[52] U.S. Cl. ..... 166/123; 166/134; 277/26

[58] Field of Search ..... 166/123, 118, 179, 181, 166/182, 134, 135, 191, 192; 277/26; 29/447; 285/381

[56] References Cited

U.S. PATENT DOCUMENTS 3,285,470 11/1966 Frei et al. ..... 148/402 X
3,520,361 7/1970 Lewis ..... 166/134
4,424,865 1/1984 Payton, Jr. ..... 166/302

FOREIGN PATENT DOCUMENTS 1319529 9/1963 France ..... 166/134

*Primary Examiner*—Stephen J. Novosad
*Assistant Examiner*—Thuy M. Bui
*Attorney, Agent, or Firm*—Jerry Cohen

[57] ABSTRACT

An improved packing tool (P1) for sealing spaces between the wall (10) of a wellbore and means (12) defining an elongate member (e.g. tubing) disposed longitudinally in the well bore including a sealing mechanism supportable peripherally about the elongate member and including at least one element (27) containing a shape memory alloy material which maintains a radially contracted condition at below a predetermined temperature—corresponding to the transition temperature of the shape memory alloy—to enable introduction of the sealing mechanism into the well bore and which responds to the temperature by transforming into a radially expanded condition to make sealing contact with the wall of the well bore, establishing a tight metal to metal seal therethrough.

23 Claims, 14 Drawing Figures

PACKING TOOL APPARATUS FOR SEALING WELL BORES

BACKGROUND OF THE INVENTION

The present invention relates generally to well tools which are used to block the flow of fluids or gasses through the annular space between tubing inserted into the well bore and the wall of the well bore by sealing off the space between them. More specifically the present invention relates to packers which are particularly useful in various wells having normal-to-high temperature well conditions as well as in hot steam injection wells, geothermal wells, and deep wells with high pressure. In addition, the packers of the present invention may also be utilized in wells with a corrosive environment.

For greater packer reliability it is essential that well bore packers have a sealing element which will establish and maintain a seal under producing conditions. Most conventional packers are reliable in wells in normal-to-medium temperature ranges and with relatively low pressure. The packer sealing elements are normally formed of an elastomeric material such as rubber. Typically, when a packer is set, the elastomer sealing element is compressed longitudinally and expanded radially to form a seal against the well casing. Methods for setting this sealing element as well as the slips in packers include the application of an upward or downward force on a tubing string, actuation by hydraulic pressure, and/or rotation of the tubing string.

However, for wells having high temperatures and high pressures, the reliability of these conventional packers is poor. Under these conditions, most elastomer seals become brittle, deteriorate or swell and lose sealing capability. Such failure is hastened by the thermal cycling that occurs, for instance, due to periodic interruptions in the steam supply. This would result in expansion and contraction of the casings and tubings, which expansions and contractions is the lower end of the tubing relative to the casing. Such shifting can vary from several inches to several feet, depending upon the particular well structure. This relative shifting between the lower ends of the casings and tubings is a factor which most conventional packer constructions are not designed for and which they cannot withstand.

Other problems associated with many conventional packers is that of leakage due to high pressures within the well bore being sealed. For example, in a typical hydraulic set packer, if the pressure within the well exceeds the effective hydraulic setting pressure, leakage past the packer seal may occur. Present packers experience great difficulty in providing an effective seal against such leakage without the application of excessive internal setting pressure. Such packers are also complex and costly to operate. Therefore, sealing elements of conventional packer assemblies are found to be not satisfactory for application in the wells having high temperatures as well as with high pressures.

Many solutions have been offered for packers at high temperatures and/or at high pressures. These have involved the application of packing elements which are constructed of fluoroelastomer (plastic) and asbestos material and are relatively difficult to mechanically compress. Various packers using such a sealing element are known. For example, see U.S. Pat. Nos. 3,381,969; 4,176,715; 4,258,926 and 4,281,840. However, such solutions are not totally corrective of the problem. At high temperatures, these sealing elements will not hold high differential pressure due to unacceptable mechanical properties of the thermoplastic when subjected to compression load to initiate the desired seal. Therefore they are inherently deficient in maintaining a leakproof joint over extended periods of time. Another disadvantage is that under high temperature conditions it is often difficult to prevent elastomeric and synthetic resin materials from being extruded from even very small clearance in the annular space.

Packing made of woven asbestos and Inconel wire has also been used for packing elements at temperatures above 500° F., see U.S. Pat. No. 4,281,840. However, when subjected to high differential pressures, leakage occurs to an extent tolerable in steam injection wells but excessive for many geothermal applications.

Other packers in the prior art have a metallic seal assembly which can be deformed and expanded radially to form a sealing engagement with the interior of the casing, see U.S. Pat. Nos. 3,389,918 and 3,472,520. However, in some cases the method of deformation of the sealing element and its construction may result in such packers providing only a very limited surface area of engagement so that the packers may be vulnerable of leakage due to high pressures within the well bore being sealed.

Yet another form or type of packer construction involves an annular metal seal ring of soft and malleable lead, see Great Britain Pat. No. 2,074,630A. This type of packer is limited in its application to low temperatures, since the melting point of lead is very low.

U.S. Pat. No. 4,127,168 discloses a packer having a plurality of frustoconical resilient metal seal rings. U.S. Pat. No. 4,178,992 discloses a metal seal plug for sealing or packing off the bore of a tubing string. Both patent describe the advantages of metal to metal seals over conventional elastomeric seals under certain conditions, such as high $H_2S$ concentration or high temperature well fluids. These packers are set in the well bore hydraulically, a means for compressing and radially expanding the metal seal ring to contact the interior of the casing string. However, problems of transmitting the necessary force to the packer are typically encountered with the hydraulic methods used by most of these packers. Hydraulic actuation has the problem of pressure fluctuation with consequent repeated releasing and resetting of the slips, often resulting in casing damage, movement of the packer and loss of sealing ability. Moreover, for setting the packer by this hydraulic method which is often with application of unnecessary excessive internal setting pressure is not a simple way and the work necessary for this purpose is very time consuming and grueling. Sometimes, to work and setting the packer can only be accomplished by the considerable effort of several people.

SUMMARY OF THE INVENTION

It is therefore an object of this invention to provide an improved packing tool for sealing well bores which overcomes the aforedescribed difficulties and, in particular, exhibits enhanced sealing qualities, providing a tight and effective seal over a wide range of well bore temperature and pressure conditions.

It is a further object of this invention to provide a packing tool for sealing well bores which is quicker, simpler, less expensive, and requires less people to operate than tools of the prior art thereby exhibiting improved efficiency and economy, It is a further object of this invention to provide such a packing tool which exhibits effective sealing qualities in corrosive well bore environments.

This invention features an improved packing tool for sealing spaces in well bores and in particular for such spaces between the bore wall and means defining an elongate member (e.g. fluid recovery tubing) which includes sealing means supportable peripherally about the elongate member and having at least one element containing a shape memory alloy material which maintains a radially contracted condition at below a predetermined temperature—corresponding to the transition temperature of the shape memory alloy—to enable introduction of the sealing means into a well bore. As used herein the term well bore typically connotes a drill hole whose wall is lined by an inserted well casing such as is known in the art. The sealing means of this invention responds to the temperature thereof rising above the transition temperature by transforming into a radially expanded condition to make sealing contact with the wall of the well bore.

In preferred embodiments, the packing tool may include a discrete tubular section which may be threadably attachable to a production tubing for recovering fluid therethrough or to a cable or other device for lowering the tubular member into and raising it from the well bore and about which the sealing means may be peripherally supported.

The sealing means may include a substantially cylindrical element of shape memory alloy the outside surface of which provides the sealing contact with the wall of the well bore. Such sealing means may also include a plurality of spring elements of shape memory alloy material, and mounted to and extending between the elongate member and the inside surface of the cylinder. Alternatively a plurality of arms of shape memory alloy material may be mounted to and extend between the elongate member and the inside surface of the cylinder. The sealing means may include one or more annular and substantially conical discs disposed about the elongate member. Each such disc has a peripheral surface for providing the sealing contact with the wall of the well bore. Preferably the discs (known as the Belleville Spring) are provided in one or more conforming parallel stacks. The sealing means may also include a series of alternating conical portions of shape memory alloy material surrounding the elongate member in the contracted condition which expand to form substantially a right cylinder when heated above the transition temperature.

The metal seal assembly with shape memory effect (which is then called: SME metal seal) is produced comprising the steps of forming the hollow body as in cylindrical or in conical shape with an external diameter greater than the internal diameter of the casing to be sealed; heat treating it to the prescribed temperature for imparting its memory configuration; thereafter cooling the same to a temperature below the transition transformation temperatures for the sealing material where the sealing bar is imparted with its intermediate configuration. When this deformed metal seal is applied to the casing to be sealed and heated to a temperature above the transition transformation temperature, the sealing bar will attempt to assume its memory configuration and it is expanded into tight sealing engagement within the well bore.

Means may be provided for heating the sealing means to above its transition temperature. Such means typically include a transformer attached to a cable and electrically connected to the elongate member and thus the actual sealing means. In certain embodiments of this invention, the seal may be heated by alternative means in the well bore, e.g. by hot steam due to thermal stimulation in the borehole, by geothermal wells or by heat sources available at the bottom of the well bore.

Under this influence of certain types of heating (e.g. steam injection) the sealing means retains its shape memory upon heating beyond its transition temperature and accordingly the sealing means responds to the temperature thereof falling below the transition temperature by transforming into the contracted condition to enable removal of the sealing means from the well bore without excessive force. In other instances, such as when heated by direct electrical means the sealing means are electrically heated until they lose their shape memory. In such cases, the sealing means have to be reheated and thus softened for removal. Alternatively, a soft metal outer lip (e.g. copper) may be provided attached to, and preferably integral with, the sealing surface of the sealing means (such provision being made prior to setting the tool) to enable grasping of the sealing means and removal thereof from the well bore.

This outer lip serves as a soft metal seal between the packer and the casing. The lip material and configuration provides a tight seal in irregular, worn and out-of-round casings, and permits the packer to be retrieved (by upward pull) without excessive force.

When the heat is provided due to steam injection during thermal stimulation in the bore hole, the metal seal temperature is raised automatically. This temperature rise causes the metal seal to expand and form a tight seal against the casing wall. The packer remains set and sealed all the time during the thermal stimulation of the well. After the thermal treatment is ended, the metal seal returns to its normal temperature, consequently shrinks and comes back to the state it was in right after being lowered into the well, that is before starting the above-described operation. Consequently, the packer is easily retrieved by pulling it out of the well.

In case the packer of this invention is used for other operations than thermal stimulation, it can be tripped by using the temperature rise due to the geothermal gradient. When the temperature in the geothermal well is too high, in releasing the packer from the well the two methods described above may be used.

The packing tool may further include retractable gripping means supportable peripherally about the elongated member and alternable between a radially retracted condition for fitting within the well bore without gripping the wall thereof and a radially extended condition for gripping the wall of a well bore in which the gripping means are fit. In such embodiments actuator means, including a shape memory alloy material responsive to the temperature thereof rising above or falling below a predetermined level—corresponding to the transition temperature of the shape memory alloy—are provided for alternating the condition of the gripping means.

Means may also be supported peripherally about the elongate member for establishing functional contact with the wall of the well bore while the packing tool is introduced therein and removed therefrom and thereby limiting rotation of the packing tool in the well bore. Such means for establishing frictional contact may include a plurality of block elements, each having a surface for contacting the wall of well bore and spring means for urging each block into such frictional contact.

The activator means may include a helical spring axially disposed about the elongate member. The spring actuator with shape memory effect (which is then called: SME spring) is produced by initially winding it in its open coiled state, so that the pitch is appropriate to 2% shear strain when the spring is compressed to its close-coiled state. Following winding, the spring passes through a number of heat treatment procedures, so as to give the spring its memory characteristics, after which, the spring will contract to its close-coiled state at temperature below the transformation and on heating above the transformation, it will expand axially to its open coiled state.

Compression means may be slidably mounted to the elongate member between the gripping means and the sealing means for slidably bearing against the sealing means in response to extension of the gripping means thereby longitudinally compressing the sealing means to enhance radial extension thereof and therefore the sealing engagement between the sealing means and the wall of the well bore. The support means may include a tapered region moving one end proximate and an opposite end distant the well of the well bore and the gripping means may include a complimentary tapered surface slidably engaging the tapered region for enabling the gripping means to slide along the tapered region between the retracted condition at the distant end of the tapered region and the extended condition at the proximate end of the tapered region.

Heating means may be provided for heating the actuator means to above the predetermined transition temperature thereof. Typically, these are the same heating means which heat the sealing means.

Shape memory is a phenomenon exhibited by a number of alloys. To date, applications utilize the NiTi-type and Cu-based alloys. The important characteristic of these alloys is their ability to exist in two distinct shapes or configurations above and below a critical transformation temperature. Below the critical temperature a martensitic structure forms and grows as the temperature is lowered. When the temperature is raised the martensite shrinks and finally disappears. This change in metallurgical structure is linked with a change in dimensions and the alloy exhibits a memory of the high and low temperature shape. The transition transformation temperature can be varied by alterations to the alloy composition.

The general pattern of bahavior is that a specimen deformed in the martensitic state completely regains its original, undeformed shape upon heating through the reverse transformation. For some time it has been realized that quite large forces or stresses are generated during the shape memory effect (SME) actions. For example, in NiTi alloys stresses as high as 100,000 psi are created by the reverse transformation of the deformed martensite to the memory configuration during heating. Such stresses/forces are an order of magnitude higher than those necessary to deform the martensite at lower temperatures. Thus, heat can be used for the creation of a mechanical force, which can be used to do work. The principle involved is well illustrated in U.S. Pat. No. 3,403,238 disclosed by Buehler, et al.

The characteristics described above illustrate the ability of shape memory spring actuator and the SME metal seal to convert heat energy into mechanical work. Therefore, an SME spring can be used as thermomechanical actuator to lift loads and more specifically, to operate the gripping means of the present invention and similarly, the SME metal seal can provide very tight sealing engagement with very high sealing force.

Examples of metallic materials which are capable of having the shape memory effect, as described above, are the alloys disclosed in U.S. Pat. Nos. 3,783,037; 4,146,392; 4,274,872; and 4,282,033; and Belgium Pat. No. 703,649. However, it should be understood that the present invention is not limited to the use of any particular type of SME alloy, but rather contemplates the use of any SME alloy, whether now known or discovered in the furture. The preferred alloys of the present invention include the Cu-based alloys such as the Cu-Zn-Al and the Cu-Al-Ni alloy, and the NiTi alloy.

Other objects, features and advantages of the invention will be apparent from the following detailed description of preferred embodiments with reference therein to the accompanying drawing in which:

DETAILED DESCRIPTION OF PREFERRED EMBODIMENTS

Figure 1A:
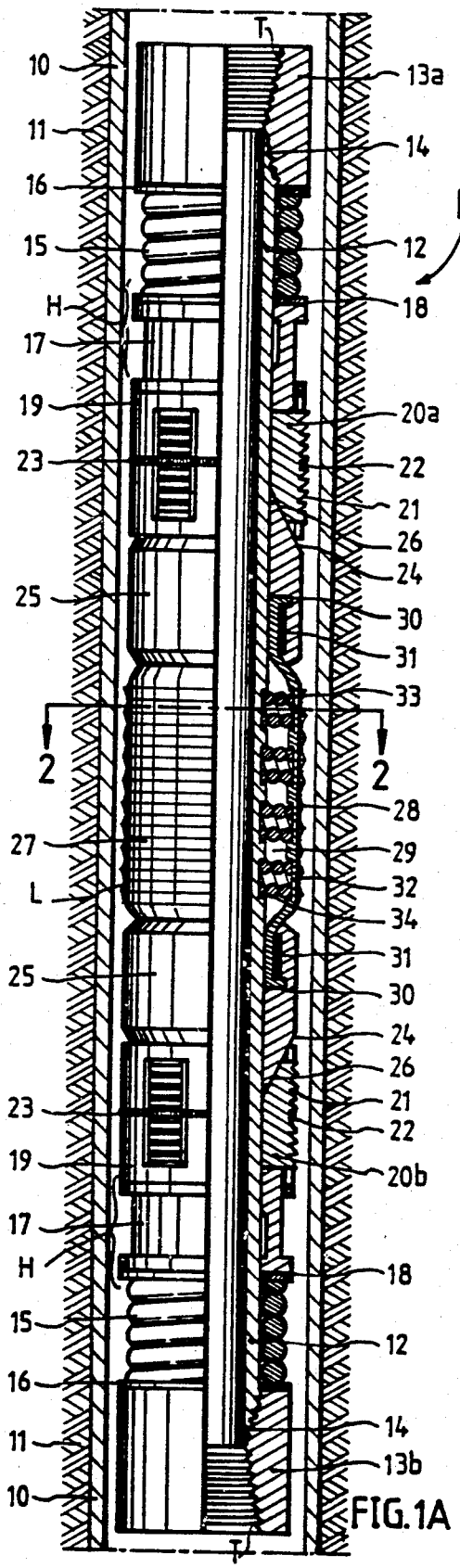
FIG. 1A is a sectional cutaway view of one of the packers constructed according to the present invention, positioned in a well bore prior to being actuated into sealing engagement therewith.
Figure 1B:
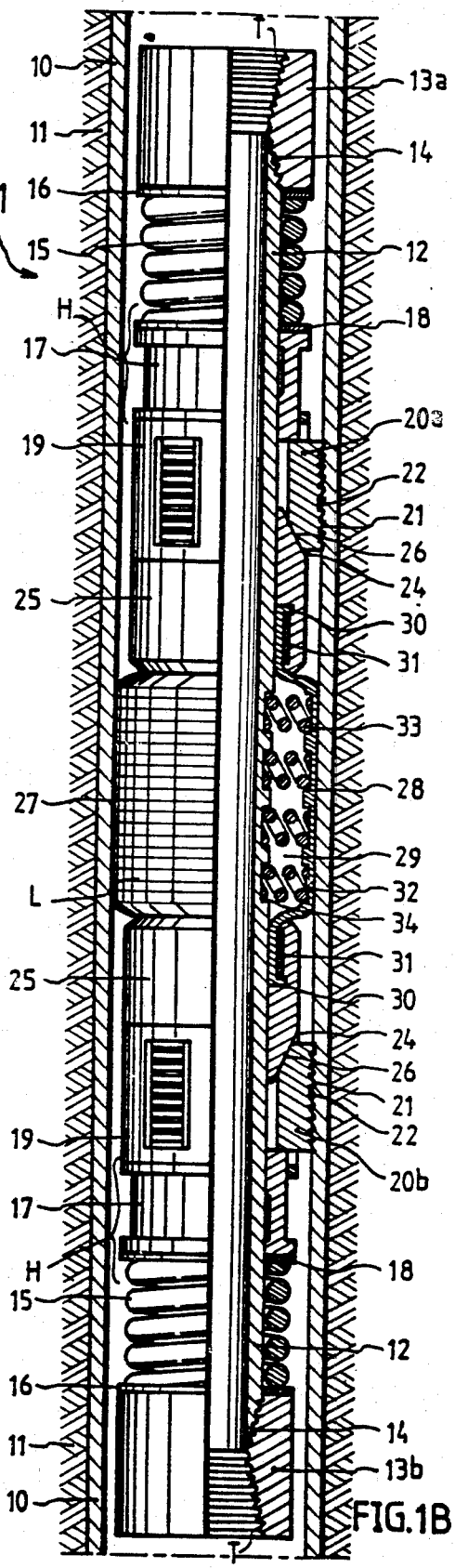
FIG. 1B is a sectional cutaway view of the tool of FIG. 1A in an actuated (e.g. sealing/gripping) condition.

As seen in the drawings, referring first to FIG. 1A and FIG. 1B, a packer (P1) in accordance with the invention before and after being set respectively, is shown as installed in a well casing 10 extending downwardly in a well bore drilled into or through earth formation 11. A transformer (not shown) connected at the end of a cable (not shown) is attached to a connector 13*a* via threads (T) for providing the required heating as described hereinafter. The packer (P1) is shown coupled to a elongate tubing string 12 by means of tubing connectors 13*a* and 13*b* which are internally threaded at 14. Production tubing (not shown) may be threadably connected to the top and bottom connectors 13*a*, 13*b* via threads (T) so such production tubing is enabled to communicate with tubing string 12 for the flow of fluids (e.g. oil or gas) therethrough. Note that such production tubing may be attached to connector 13*a* following removal of the above described cable/transformer apparatus, where such apparatus is employed. Below about the upper connector 13*a* is the holding device assembly (H) and the same arrangement is also provided above the lower connector 13*b*. Each of the holding device assemblies includes a helical compression coil actuator 15 which is isolated at its both ends by non-conductor rings 16 from contact with the connector 13 and overshot slip sleeve 17. The overshot slip sleeve 17 is shown having flat annular surface 18 at which the activated force of the spring 15 will be released and transmitted to a retainer sleeve 19. Within each retainer sleeve 19, is a gripping means slip element 20*a*, 20*b* which is extendable outwardly into anchoring engagement with the casing 10. Slips 20*a* and 20*b* have serrated cylindrical exterior surfaces with gripping teeth 21 containing circumferential channels 22. A small metal wire 23 encircles slips 20*a* and 20*b* in channels 22 to retain them in retracted position prior to setting of the spring actuator 15. The tapered surfaces 26 of slips 20*a* and 20*b* rest on the tapered radial surfaces 24 of wedge cages 25, which are oriented at substantially the same angle as interior surfaces 26 of slips 20*a* and 20*b*. Between the upper and lower wedge cage 25 is a SME metal seal assembly (or it is also called: packer sleeve) 27. The exterior of the sleeve 27 has a straight cylindrical outer sealing surface 28, which surface is coextensive with the longitudinal extent of sleeve 27. The interior of sleeve 27 is provided with or defines a straight cylindrical bore 29. The upper and lower ends of sleeve 27 are provided with seats 30 each of which is separated from the internal surface of mouth of a respective cage 25 by a sealing ring 31 to establish tight wedging and sealing engagement. In practice, the cage mouth is provided with an angle disposed at 45° to the axial of the construction so that when the metal seal assembly 27 expands during the setting (e.g sealing operation), the slidable cages 25 hold the ends of the packer sleeve 27 captive, urge the ends radially inward and tight against the cages 25 and establish wedging sealing engagement therewith.

The packer sleeve 27 is manufactured and made of shape memory alloy. It is provided with a plurality of longitudinally and annularly spaced, radially inwardly opening relief grooves 32. The grooves are rectangular and are adapted to each receive one end of a spring actuator 33. Each spring actuator 33 is also made of shape memory material and fabricated in the same manner as that for spring actuator 15 in the holding device. In practice, there are a number of groove arrangements and in preferred constructions of this invention there are four longitudinally spaced series or grooves, one such series show in FIGS. 1A, and 1B, each series including four annularly spaced grooves, FIG. 2A or six (6) annularly spaced grooves, FIG. 2B.

As seen in FIGS. 1A, 1B and FIGS. 2A, 2B, the exterior of the tubing string within the metal seal assembly must be also provided with the grooves 34, for receiving the opposite end of each spring 33. Grooves 34 are similar to the grooves at the interior of the packer sleeve 27. Each spring 33 is thus mounted to and extends between cylindrical packer sleeve 27 and tube 12.

Figure 2A:
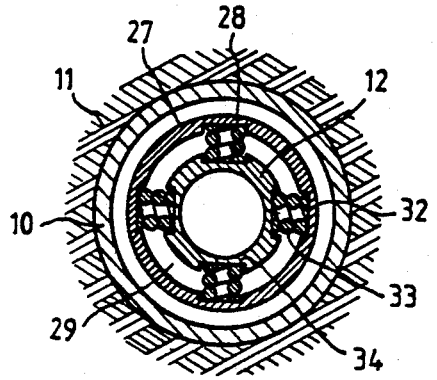
FIGS. 2A, 2B are cross sectional views taken along the line 2—2 of FIG. 1A illustrating two possible spring arrangements for the sealing means.
Figure 2B:
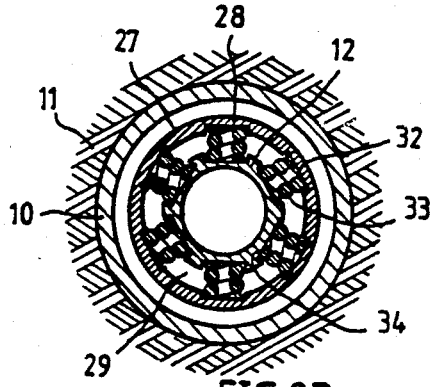

In the embodiment of FIG. 2A the total number of springs used to force the packer sleeve 27 is $4\times4=16$ springs, whereas the arrangement in FIG. 2B needs $4\times6=24$ springs.

When the tool is activated by heating the metal seal assembly 27 and the spring actuator 15 to above the transition temperature of the shape memory alloy materials of each by using electrical current (e.g. by activating the transformer via the introducing cable) or by injecting hot steam down the well bore, the packer sleeve 27 will expand. This expansion is generated by the sleeve 27 itself plus the support of the springs 33 due to their shape memory expansion during heating. This combination expansion of both sleeve 27 and springs 33 provides a very tight and effective seal against the casing wall.

At the same time, the spring actuators 15 also expand, urging the slips 20*a*, 20*b* into tight gripping engagement against the casing wall so that packer (P1) and the sealing packer sleeve 27 are prevented from sliding longitudinally in the well bore. This movement of slips 20*a*, 20*b* also provides a slide movement of the wedge cage 25 to bear against and thus longitudinally compress assembly 27 thereby expanding packer sleeve 27 radially outwardly to improve and establish a positive fluid tight seal. Fluid may then be recovered via attached production tubing and the communicating tubing string 12 interposed there between.

Figure 3A:
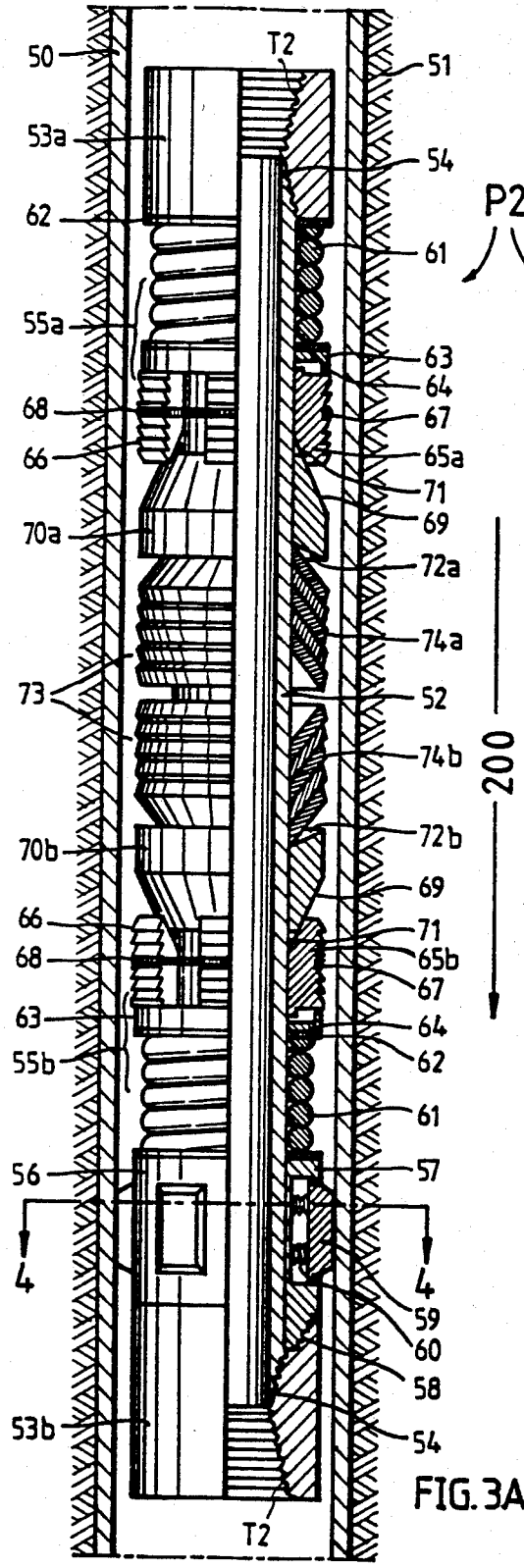
FIG. 3A is a sectional cutaway view of an alternative packer constructed according to the present invention positioned in a well bore prior to being actuated into sealing engagement therewith.
Figure 3B:
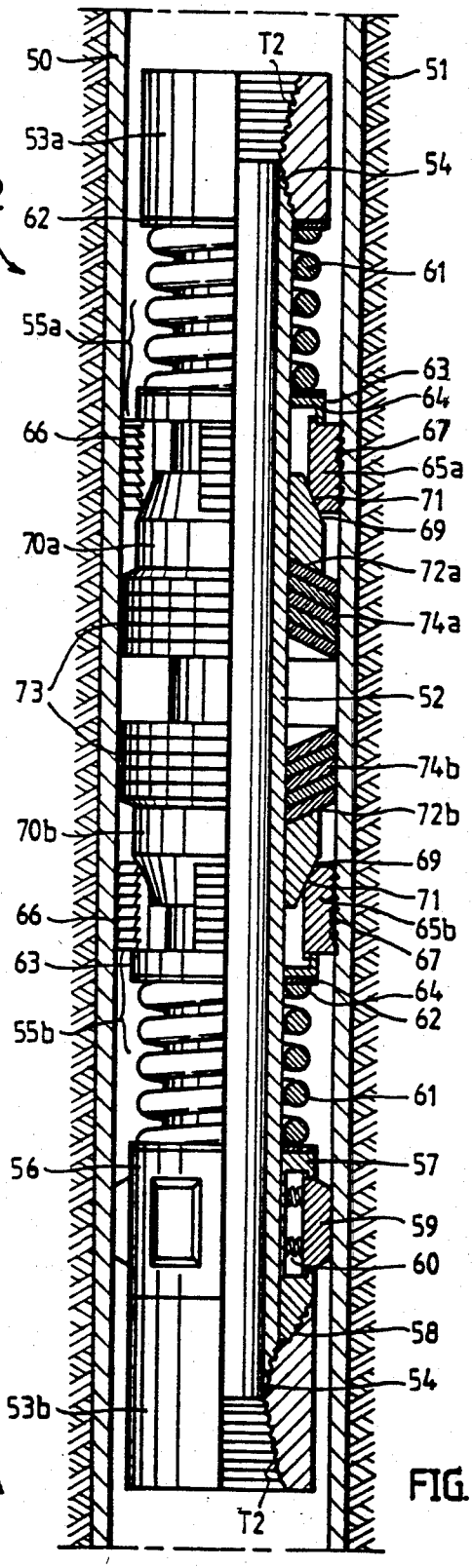
FIG. 3B is a sectional cutaway view of the tool of FIG. 3A in an actuated (e.g. sealing/gripping) condition.

Referring now to FIGS. 3A and 3B, another packer assembly (P2) of the present invention is illustrated. FIG. 3A shows a longitudinal view of the packer of the present invention run into a well casing 50 which is drilled into earth formation 51, whereas FIG. 3B is a view corresponding to FIG. 3A, illustrating the position of the component parts of the packer (P2) subsequent to the setting of the packer in the well bore.

Figure 4:
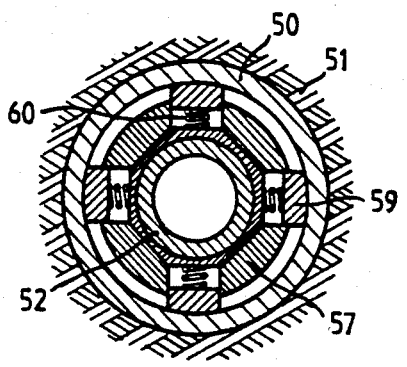
FIG. 4 is a cross sectional view taken along the line 4—4 of FIG. 3A.

The packer comprises a tubular body (or tubing string) 52 which is coupled at its both ends by means of tubing connectors 53*a* and 53*b*, respectively, provided by the internal thread 54 of the connectors 53. Again, a connecting cable and transformer may be attached threadably to connector 53. Below the upper connector 53*a* is an upper holding device assembly 55*a*. A lower holding device assembly 55*b* is provided above a control guide 56. The purpose of control guide 56 is to secure the packer during the introduction and sealing operation. This unit includes a control sleeve 57 which is threadably connected to lower connector 53*b* at 58 and which receives drag blocks 59. These drag blocks are urged outwardly into frictional contact with the casing wall 50 by means of compression springs 60. The drag block assembly interacts with casing wall 50 when the packer is being lowered in the direction of arrow 200 into the well bore. The purpose of this drag block assembly is to prevent circumferential rotation of the packer when lowering and setting the packer. The relationship of drag blocks assembly 59, tubing string 52, and well casing 50 is best seen in FIG. 4.

Holding device assembly 55*a* includes a helical compression coil actuator 61 which is formed of a shape memory alloy material and is isolated at its both ends by a non-conductor ring 62 from contact with an overshot slip sleeve 63 and the upper connector 53*a*. Assembly 55*b* likewise includes a spring actuator 61 which is isolated at both ends by a non-conductor ring 62 from contact with an overshot slip sleeve 63 and control sleeve 57. Each overshot slip sleeve 63 is shown having flat annular surface 64 at which the activated force of a spring 61 will be transferred to the upwardly holding slips 65*a* and downwardly holding slips 65*b* respectively. Both slips 65*a* and 65*b* have serrated cylindrical exterior surfaces with gripping teeth 66 containing circumferential channels 67. A small metal wire 68 encircles slips 65*a* and 65*b* in channels 67 to retain them in retracted position prior to setting of the packer. The tapered ends 71 of slips 65*a* and 65*b* rest on the radial surfaces 69 of wedge ring 70*a* and 70*b*, which are oriented at substantially the same angle as interior surfaces 71 of slips 65*a* and 65*b*. Lower surface 72*a* of upper wedge ring 70*a* extends radially outward and downward at a shallow radial angle. Similarly, upper surface 72*b* of lower wedge ring 70*b* extends radially outward and upward at a shallow radial angle.

A SME metal seal assembly 73 is disposed about the tubing string 52 between downward-facing upper wedge ring 70*a* and upward-facing lower wedge ring 70*b*. The annular metal seal segments are a plurality of substantially identical downward-facing conical disks 74*a*. Similarly, a plurality of substantially identical upward-facing conical disks 74*b* are located above the lower wedge ring 70*b*. Conical disks 74*b*, like disks 74*a*, are of substantially the same outer diameter in their unexpanded state and are stacked in parallel. These conical disks (which are also called Belleville springs) are made of shape memory alloy.

Figure 5:
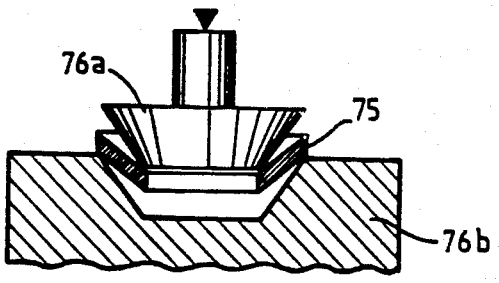
FIG. 5 shows an apparatus for making a coned-disk spring (or Belleville spring) used by the tool of FIGS. 3A, 3B.

As shown in FIG. 3A, the conical disks have smaller outside diameter in their unexpanded state compared with the internal diameter of the well casing. This conical disk with small outer diameter 74 has been obtained by forming a larger conical disk 75 as illustrated in FIG. 5. The disk dimension is reduced from 75 to 74 at temperature below its transformation temperature and forming pressure is applied to die 76*a* by means of female die 76*b* to deform disk 75. The configuration of die 76 will vary according to the original shape of disk 75 and the configuration of the deformation which it is desired to impart.

The setting operation of the packer of the present invention is made by heating the metal seal assembly 73 and the spring actuators 61. On heating to about the transition temperature of the shape memory alloy, the deformed disk 74 will expand approximately to its original shape of disk 75, FIG. 4. This provides positive, metal-to-metal engagement and achieves a very effective seal against the casing wall, FIG. 3B. The gripping setting of slips 65*a* and 65*b* is activated by the force exerted by the spring actuators 61. The outward movement of slips 65 will break metal wire 68, permitting slips 65 to contact the inner wall of casing 50 via the gripping teeth 66. (The engagement of upper slips 65*a* restricts any further downward movement of the tool, while the engagement of lower slips 65*b* restricts any possible upward movement of the tool). The expansion of spring actuators 61 during setting the slips 65 will effect movement of the wedge rings 70*a* and 70*b* toward the conical disk assembly which causes incresed compression of all packer disks 74*a*, 74*b*, increasing their effective diameter, and causing an effective contact with casing wall 50. Again, unpictured production tubing attachable via threads (T2) of connectors 53*a*, 53*b* may communicate with tube 52 and thus enable fluid recovery.

Figures 6A, 6B:
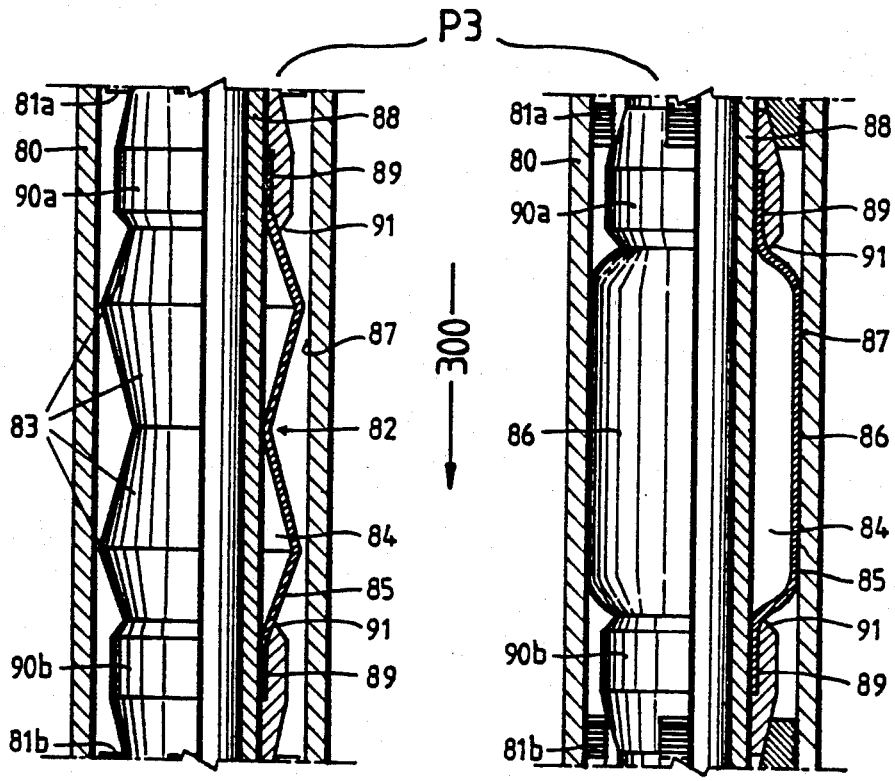
FIG. 6A is a sectional cutaway view of the seal assembly of a third packer according to the present invention positioned in a well bore before being actuated to seal the well bore.
FIG. 6B is a sectional cutaway view of the packer of FIG. 6A after actuation thereof into sealing engagement with the wall of the well bore.

Referring now to FIG. 6A and FIG. 6B, another metal seal assembly 82 of packer (P3) of the present invention is illustrated. Basically, this type of packer has similar component parts, including gripping means as those described in the previous drawings (FIGS. 1A, 1B, and FIGS. 3A, 3B) of the packers (P1 and P2) of the present invention. However, the difference is only found on the construction of its metal seal 82.

As shown in FIG. 6A, the packer is being lowered in the direction of arrow 300 into a well casing 80 whereby the slips 81*a*, 81*b* and the metal seal assembly 82 are positioned in preparation to being actuated into sealing engagement. The metal seal assembly 82 employs a packing sleeve having a plurality of tapered (coned) metal cages 83, constructed of a shape memory alloy. The seal 82 is fabricated originally as a cylindrical body having a straight cylindrical outer surface (see FIG. 6B) and a hollow interior body 84 defined by an annular skirt portion 85. The thickness of the annular skirt 85 is designed to be sufficient to withstand the maximum differential pressure to which the expanded sleeve 86 will be subjected when installed to form a tight seal against the casing wall 87.

Seal 82 is first fabricated by any of several fabrication operations, such as casting, rolling, or the like, to provide a sheet metal form. This will subsequently be followed by welding to provide the sleeve 86 with an outside diameter greater than the internal diameter of the casing being sealed.

Next, the sleeve 86 is provided with a number of heat treatment procedures to obtain its memory property. This will be followed by a processing that includes changing its physical dimensions. This step involves maintaining the metal temperature of the sleeve below its transformation temperature while operating on the sleeve to form the sleeve into multiple coned-like shapes 83 as depicted in FIG. 6A. (This will allow to reduce its outside diameter to a dimension that will permit it to be readily inserted into the casing bore to be sealed.) The operation employed for this purpose must be one involving forming the material to its desirable dimensions. Thus, the seal 82 can be imparted with its intermediate configuration by a cold working operation such as by means of stamping or swaging dies or the like, which procedure can provide the shape as illustrate in FIG. 6A.

After the seal 82 has been provided with its intermediate configuration in the plurality of conical cage forms 83, it is ready for mounting onto the tubing string 88 of the packer. The upper and lower ends of the seal 82 are provided with seats 89 which are tightly wedged by the wedge cages 90*a* and 90*b*. These wedge cages 90 are slidable, so that when the conical cages 83 expand on heating, both wedge cages 90*a* and 90*b* will move toward the metal seal assembly 82 providing compression and a tight sealing engagement between the wedge cage mouths 91 and the seats 89.

Upon setting the packer in the desired depth of the well casing 80, the conical cages 82 will inherently attempt to revert to its memory configuration on heating to above the transition temperature as seen in FIG. 6B. Because the outside diameter of the expanded sleeve 86 in its memory configuration is greater than the internal diameter of the casing 80, the sleeve will be expanded into tight sealing engagement with the casing wall 87. The mechanical stress produced in the sleeve by the constraining casing 80 produces an expansion force between the two members to retain the sleeve 86 within the casing 80 and in sealing engagement therewith.

Further movement of the wedge cages 90*a* and 90*b* toward the compression on the seal assembly is provided due to the compression of the upper slips 81*a* and lower slips 81*b* during their engagement against the casing wall 87. This will provide additional compression of expanded sleeve 86 of seal 82 thereby enhancing radial expansion of sleeve 86 and the sealing engagement with casing wall 87.

Figure 7A:
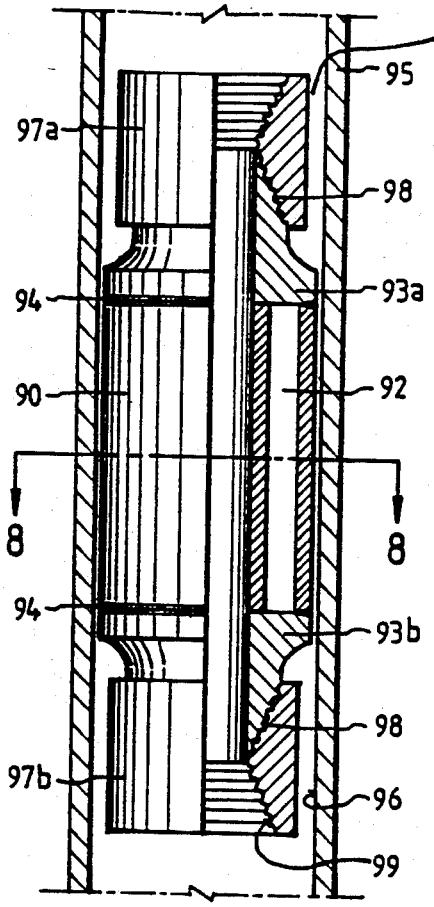
FIG. 7A is a sectional cutaway view of the seal assembly of a fourth packer according to the present invention positioned in a well bore before being actuated.
Figure 7B:
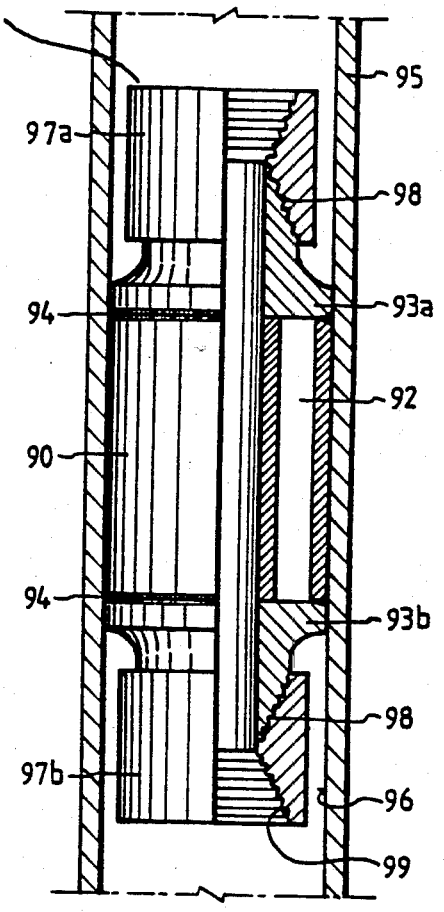
FIG. 7B is a sectional cutaway view of the packer of FIG. 7A after actuation thereof into sealing engagement with the wall of the well bore.
Figure 8:
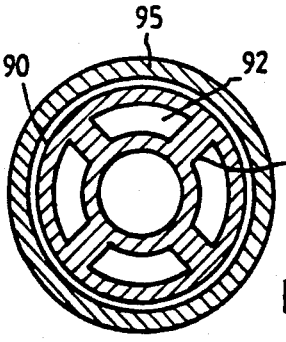
FIG. 8 is a view generally along the line 8—8 of FIG. 7A.

Still another metal seal assembly for packer (P4) of the present invention is illustrated in FIGS. 7A, 7B. This assembly is constructed by means of a simple design in a typical form of tube plug 90. Plug 90 is formed from the shape memory material, and is fabricated as a cylindrical body having four arms 91 extending longitudinally within a hollow interior 92 as clearly seen in FIG. 8. The plug 90 is fabricated by several fabrication processes, such as casting, extrusion, or the like, to provide the plug with an outside diameter greater then the internal diameter of the casing being sealed. Plug 90 is then joined at its ends with sleeve connectors 93*a* and 93*b*. These joints at 94 may be obtained by welding operation. The sleeve connectors 93*a* and 93*b* are fabricated from the same shape memory alloy as for the plug 90.

Following fabrication, the metal seal member (the plug 90 plus the sleeve connectors 93) passes through a number of heat treatment procedures, so as to give the metal seal member its memory characteristics.

Next, the metal seal member is provided its intermediate (contracted) configuration. This step involves maintaining the metal temperature of the member below its transformation temperature range while operating on the member to reduce its outside diameter to a dimension that will permit it to be readily run-in into the well casing 95 to be sealed, FIG. 7A. The operation employed for this purpose must be one involving straining the material to its desirable dimension. Thus the metal seal member 90 can be imparted with its intermediate configuration by a cold working operation such as by means of swaging or by a cold drawing procedure.

When the metal seal member 90 with its intermediate configuration, as shown in FIG. 7A, is heated above its transformation temperature the member 90 will inherently attempt to revert to its initial shape by expansion of the outside diameter of the body. Because the outside diameter of the metal seal member in its memory configuration is greater than the inner diameter of the casing 95, the metal seal member will be expanded into tight engagement and provides a very effective seal against the casing wall 96 (see FIG. 7B). The mechanical stress produced in the metal seal member 90 by the constraining casing produces an expansion force between the two members to retain the member body within the casing bore and in a tight sealing engagement therewith.

As seen in FIG. 7, the sleeve connectors 93*a* and 93*b* are provided with tubing connectors 97*a* and 97*b* at threads 98. The tubing connectors are internally threaded at 99 for connecting to unpictured production tubing.

In concern with the corrosion behavior, the shape memory alloy of NiTi type is almost superior at any condition of the well bores, including in $H_2S$ environment. However, for shape memory alloys of copper-based alloys for corrosion protection in hostile environments, the coating or plating is recommended. Note that excessively thick or brittle coatings should be avoided as they may crack during shape recovery.

Setting and releasing the packers (P1–P4) of the present invention is performed as follows: The invention is characterized by the provision of a thermally responsive metal seal made of a memory material that deforms from a set (intermediate) shape toward an original shape when subjected to a temperature level above its transformation temperature range. The mechanical deformation of the metal seal into its original shape is utilized to provide a sealing function and is effected by a heater mechanism that generates heat energy internally of the metal seal so as to produce a temperature in the given value range. By heating the metal seal, the conversion from thermal to mechanical energy is obtained. Preferred methods of heating include a direct circulation of heating current through the metal seal or the generation of heating current therein by induction. However, heating the metal seal by absorption of other forms of heat energy is also contemplated such as: hot steam due to thermal stimulation in the borehole, geothermal wells or heat source available at the bottom hole of the well bore.

For heating by direct electrical current or by induction, the packers (P1–P4) of the present invention are able to be set in the casing by a conductor cable wire setting tool which comprises a transformer (Tr), (FIG. 1 only), being used to supply electrical current to heat and activate the metal seal assembly and the holding device. This setting operation is preferrable for those wells with normal to moderate temperatures. The metal seal will expand continuously under the heat effect which consequently seals the annular space between its outer periphery and the walls of the casing. The temperature reached is above the transformation temperature of the metal seal and above its structural limit, until it loses its memory so that the packers remain set and sealed all the time. To release the packer from the casing wall, there are two possible ways recommended, namely: First by supplying the electrical current to re-heat the metal seal until it becomes soft and permit the packer to be retrieved (by upward pull) without excessive force. Secondly, by providing an outer lip (L), (FIG. 1), on the outer metal seal surface prior to setting. Note that for clarity the view of lip (L) is simplified. It peripherally surrounds seal of this outer lip (L) (e.g. copper) serves as a soft metal seal between the packer and the casing. It may be integral with sealing surface 28. The lip material and configuration provides a tight seal in irregular, worn and out-of-round casing, and permit the packer to be retrieved (by upward pull) without excessive force. Such a lip may be provided in any of the embodiments of the invention.

Figure 9:
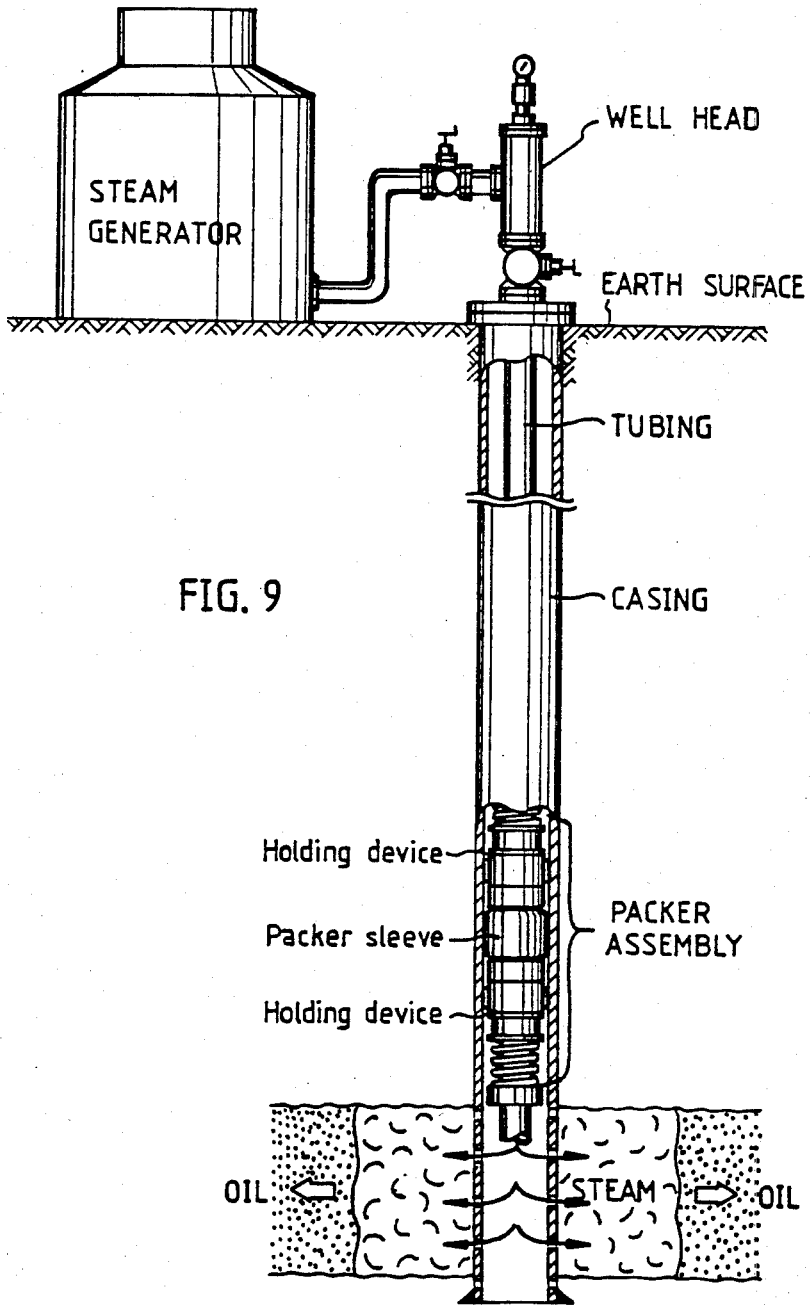
FIG. 9 is a schematic elevation view partially in section and illustrates apparatus (packer) assembled in accordance with the present invention positioned in a hot steam injection well.

When the heat is provided due to steam injection during thermal stimulation in the bore hole, the metal seal temperature is raised automatically. This temperature rise causes the metal seal of packers (P1–P4) to expand and form a tight seal against the casing wall. The packer remains set and sealed all the time during the thermal stimulation of the well (see FIG. 9). In the steam injection process (FIG. 9), steam is injected into the reservoir to heat and displace heavy oil toward producing wells (not pictured). As seen in FIG. 9, the injection is performed through the tubing string, which is provided at its end with a packer which insulated and protects the well casing from the direct contact with the injected hot steam. The use of the packer in steam injection well is necessary because it increased the thermal recovery efficiency due to the fact that the hot steam, having higher velocity in the tubing, reaches the formation with a higher temperature. High temperatures encountered during steam injection processes, however, place unique demands on packers used in steam injection operations. Most of the existing packers cannot withstand with this high temperature operations. The packers of the present invention such as the one illustrated in FIG. 9) can overcome the problem even in the injection well with a higher pressure that most packers cannot withstand. After the thermal treatment is ended, the metal seal returns to its normal temperature, consequently shrinks and comes back to the state it was in right after being lowered into the well, that is before starting the afore-described operation. Consequently, the packer (P1–P4) is easily retrieved by pulling it out of the well.

In case the packer (P1–P4) of this invention is used for other operations than thermal stimulation, it can be tripped by using the temperature rise due to the geothermal gradient. When the temperature in the geothermal well is too high, in releasing the packer from the well the two methods as the afore-described operation may be recommended, i.e. to increase the temperature (heating by electric current) of the metal seal until it becomes soft and easier to pull out and/or to put a soft metal seal lip on the metal seal surface before being lowered into the well bore.

The packers (P1–P4) of the present invention can also be set in another economical way by using the heat source available on the bottom hole of the well bore. In case the temperature in the well is too high, the procedure of setting and releasing the packer is similar to that in the geothermal wells. However, for some wells with normal to moderate temperatures, the setting operation may be obtained by maintaining the temperature of the metal seal well below the temperature of the well. This may be accomplished by providing a cooling fluid circulation to the metal seal assembly while it is being lowered into the well bore. By stopping the coolant circulation during the setting operation, the metal seal will be expanded due to raising its temperature. To release the packer from the well, a releasing tool comprises with a coolant circulation may be again lowered to the packer. As soon as the metal seal cooled down, it loses its sealing engagement and the packer is ready to pull out of the well.

It is necessary to be noted here that in some cases in order to avoid any premature set of the packer, the metal seal as well as the holding device may be isolated from the outside temperature effect during running-in into the well bore.

It is evident that those skilled in the art, once given the benefit of the foregoing disclosure, may now make numerous other uses and modifications of, and departures from, the specific embodiments described herein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is claimed is:

1. An improved packing tool for sealing spaces between the wall of a well bore, and means defining an elongate member disposed longitudinally in the well bore comprising, substantially cylindrical metal sealing means supportable peripherally about said elongate member and a plurality of helical spring elements extending between said elongate member and the inside surface of said sealing means said sealing means and said helical spring elements containing a shape memory alloy material which maintains a radially contracted condition at below a predetermined temperature—corresponding to the transition temperature of said shape memory alloy—to enable introduction of said sealing means into said well bore and which responds to the temperature thereof rising above said transition temperature by transforming into a radially expanded condition to urge said sealing means to make sealing contact with the wall of said well bore.

2. Apparatus in accordance with claim 1 wherein said sealing means responds to the temperature thereof falling below said transition temperature by transforming into said contracted condition to enable removal of said sealing means from said well bore.

3. Apparatus in accordance with claim 1 further including means for heating said sealing means to said predetermined temperature level.

4. Apparatus in accordance with claim 3 further including compression means slidably mountable to said elongate member between said gripping means and said sealing means for slidably bearing against sealing means in response to extension of said gripping means thereby longitudinally compressing said sealing means to enhance radial extension thereof and, therefore, the sealing engagement between said sealing means and the wall of said well bore.

5. Apparatus in accordance with claim 3 further including a tapered region supportable peripherally about said elongate means and having one end proximate and an opposite end distant the wall of said well bore and wherein said gripping means include a complementary tapered surface slidably engaging said tapered region between said retracted condition at said distant end of said tapered region and said extended condition at said proximate end of said tapered region.

6. Apparatus in accordance with claim 3 wherein said means for heating include electrical means.

7. Apparatus in accordance with claim 1 further including a metal lip portion attached to the sealing surface of said sealing means for enabling grasping of said sealing means for removal thereof from said well bore.

8. Apparatus in accordance with claim 7 wherein said lip portion is integral with the sealing surface of said sealing means.

9. Apparatus in accordance with claim 1 further including retractable gripping means supportable about said elongate member and alternatable between a radially retracted condition for fitting within said well bore without gripping the wall of a well bore in which said gripping means are fit and activator means including a shape memory alloy material responsive to the temperature thereof rising above a predetermined level—corresponding to the transition temperature of said shape memory alloy—for expanding to urge said gripping means into radially extended condition.

10. Apparatus in accordance with claim 9 further including compression means slidably mountable to said elongate member between said gripping means and said sealing means for slidably bearing against said sealing means in response to extension of said gripping means thereby longitudinally compressing said sealing means to enhance radial extension thereof and therefore the sealing engagement between said sealing means and the wall of said well bore.

11. Apparatus in accordance with claim 9 further including a tapered region supportable peripherally about said elongate means and having one end proximate and an opposite end distant the wall of said well bore and wherein said gripping means include a complementary tapered surface slidably engaging said tapered region for enabling said gripping means to slide along said tapered region between said retracted condition at said distant end of said tapered region and said extended condition at said proximate end of said tapered region.

12. Apparatus in accordance with claim 9 wherein said actuator means include a helical spring axially disposed about said elongate member.

13. Apparatus in accordance with claim 9 further including means for heating said actuator means.

14. An improved packing tool for sealing spaces between the wall of a well bore and an elongate member (e.g. tubing) longitudinally disposed in the well bore comprising:

sealing means supportable peripherally about said elongate member and including at least one element containing a shape memory alloy material which maintains a radially contracted condition at below a predetermined temperature—corresponding to the transition temperature of said shape memory alloy—to enable introduction of said sealing means into said well bore and which responds to the temperature thereof rising above said transition temperature by transforming into a radially expanded condition to make sealing contact with the wall of said well bore, retractable gripping means supportable peripherally about said elongate member and alternatable between a radially retracted condition for fitting within said well bore without gripping the wall thereof and a radially extended condition for gripping the wall of a well bore in which said gripping means are fit, and helical spring activator means disposed about said elongate member and including a shape memory alloy material responsive to the temperature thereof rising above a predetermined level—corresponding to the transition of said shape memory alloy—for expanding to urge said gripping means into the radially extended condition of said gripping means.

15. Apparatus in accordance with claim 14 further including means for heating said sealing means and actuator means to said predetermined temperature level.

16. Apparatus in accordance with claim 15 wherein said means for heating include electrical means.

17. Apparatus in accordance with claim 14 wherein said gripping means responds to the temperature thereof falling below said transition temperature by transforming into a contracted condition to retract said gripping means.

18. An improved packing tool for sealing spaces in a well bore comprising:

means defining an elongate tube section longitudinally disposable in said well bore, means for connecting said tube section to fluid production tubing disposable in said well for enabling fluid communication between said tube section and such production tubing, and sealing means supportable peripherally about said tube section and including at least one element containing a shape memory alloy material which maintains a radially contracted condition at below a predetermined temperature—corresponding to the transition temperature of the shape memory alloy—to enable introduction of said sealing means into said well bore and which responds to the temperature thereof rising above said transition temperature by transforming into a radially expanded condition to make sealing contact with the wall of said well bore, and retractable gripping means supportable peripherally about said tube section and alternatable between a radially retracted condition for fitting within said well bore without gripping the wall thereof and a radially extended condition for gripping the wall of a well bore in which said gripping means are fit and helical spring activator means disposed about said tube section and including a shape memory alloy material responsive to the temperature thereof rising above a predetermined level—corresponding to the transition temperatures of said shape memory alloy—for expanding to urge said gripping means into the extended condition.

19. Apparatus in accordance with claim 18 further including means for heating said sealing means to above said predetermined temperature level.

20. Apparatus in accordance with claim 19 wherein said means for heating also heats said actuator means to above said predetermined temperature level.

21. Apparatus in accordance with claim 19 wherein said means for heating include electrical means.

22. Apparatus in accordance with claim 18 and further comprising means defining a seal, between the packing tool and well bore, which is expandable on local heating thereof under local temperature use of ambient surroundings to limit relative movement between the packer and casing and seal the space therebetween, said means being automatically contractable on local cooling to break the seal and allow ease of relative movement between the tool and bore.

23. Apparatus in accordance with claim 22 wherein the lip is integral to said sealing means.

* * * * *